US008090467B2

(12) United States Patent
Minami et al.

(10) Patent No.: US 8,090,467 B2
(45) Date of Patent: Jan. 3, 2012

(54) APPARATUS AND METHOD FOR KNITTING FABRIC USING ELASTIC YARNS

(75) Inventors: Masaki Minami, Wakayama (JP); Hiroshi Minamide, Wakayama (JP); Hirokazu Nishitani, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 0 days.

(21) Appl. No.: 12/921,241

(22) PCT Filed: Mar. 6, 2009

(86) PCT No.: PCT/JP2009/001030
§ 371 (c)(1),
(2), (4) Date: Sep. 7, 2010

(87) PCT Pub. No.: WO2009/110249
PCT Pub. Date: Sep. 11, 2009

(65) Prior Publication Data

US 2011/0010002 A1 Jan. 13, 2011

(30) Foreign Application Priority Data

Mar. 7, 2008 (JP) ..... 2008-058088

(51) Int. Cl.
*D04B 15/78* (2006.01)

(52) U.S. Cl. ..... 700/141; 66/126 R

(58) Field of Classification Search ..... 66/126 R, 66/64, 127, 132 T; 700/141, 130–133
See application file for complete search history.

(56) References Cited

U.S. PATENT DOCUMENTS

| | | | | |
|---|---|---|---|---|
| 3,858,416 | A | 1/1975 | White et al. | |
| 5,369,966 | A * | 12/1994 | Morita et al. | 66/132 R |
| 5,606,875 | A * | 3/1997 | Nishitani et al. | 66/77 |
| 6,010,052 | A * | 1/2000 | Leins et al. | 226/44 |
| 6,079,656 | A * | 6/2000 | Schmodde et al. | 242/365.7 |
| 6,550,285 | B2 * | 4/2003 | Nishitani | 66/146 |
| 7,289,869 | B2 * | 10/2007 | Morita | 700/141 |
| 7,363,101 | B2 | 4/2008 | Nishitani et al. | |
| 7,493,188 | B2 * | 2/2009 | Minakata et al. | 700/141 |
| 2011/0010002 | A1 * | 1/2011 | Minami et al. | 700/141 |

FOREIGN PATENT DOCUMENTS

| | | | |
|---|---|---|---|
| JP | 1-49816 | B2 | 10/1989 |
| WO | 2008/032451 | A1 | 3/2008 |

* cited by examiner

*Primary Examiner* — Danny Worrell
(74) *Attorney, Agent, or Firm* — Rothwell, Figg, Ernst & Manbeck, P.C.

(57) ABSTRACT

To provide an apparatus and a method for knitting fabric using elastic yarns, in which the elastic yarns are able to be used while correcting the difference between the set tension and the actual tension without being subject to a lowered knitting efficiency or restrictions to knitting patterns.

In a knitting machine 1, a tension meter 7 detects the actual tension T2 of a rubber yarn 5 when a carriage 3 reverses the running direction outside the knitting width of a fabric 9. The yarn sending length F at which the rubber yarn 5 is sent out from a yarn sending device 8 to a yarn route pathway for each knitting course is able to be obtained in advance as the length of the rubber yarn 5 consumed under the designated tension T1 for each knitting course. The yarn sending length F is corrected in such a manner that the difference between natural lengths L1, L2 of the rubber yarn 5, existing in the yarn route pathway under the set tension T1 and the actual tension T2, decreases.

5 Claims, 4 Drawing Sheets

(a)

(b)

| KNITTING COURSE | KNITTING DIRECTION | ACTUAL TENSION RIGHT BBEFORE COURSE | SET TENSION | THEORETICAL SENDING LENGTH | ADJUSTMENT RATIO(%) | | | CORRECTION VALUE OF SENDING LENGTH |
|---|---|---|---|---|---|---|---|---|
| | | | | | β | PREVIOUS VALUE | FINAL VALUE | |
| 1 | → | t 0 | t 0 | F 0 | 1 0 0 | 1 0 0 | 1 0 0 | F 0 |
| 2 | ← | | t 0 | F 0 | 1 0 0 | 1 0 0 | 1 0 0 | F 0 |
| 3 | → | t 1 | t 0 | F 0 | 7 3 | 1 0 0 | 7 3 | 0. 73 × F 0 |
| 4 | ← | | t 0 | F 0 | 7 3 | 1 0 0 | 7 3 | 0. 73 × F 0 |
| 5 | → | t 2 | t 0 | F 0 | 1 0 4 | 7 3 | 7 5 | 0. 75 × F 0 |
| 6 | ← | | t 0 | F 0 | 1 0 4 | 7 3 | 7 5 | 0. 75 × F 0 |
| 7 | → | t 3 | t 0 | F 0 | 1 1 4 | 7 5 | 8 5 | 0. 85 × F 0 |
| 8 | ← | | t 0 | F 0 | 1 1 4 | 7 5 | 8 5 | 0. 85 × F 0 |
| ⋮ | ⋮ | ⋮ | ⋮ | ⋮ | ⋮ | ⋮ | ⋮ | ⋮ |

APPARATUS AND METHOD FOR KNITTING FABRIC USING ELASTIC YARNS

CROSS REFERENCE TO RELATED APPLICATION

This application is a 35 U.S.C. 371 National Phase Entry Application from PCT/JP2009/001030, filed Mar. 6, 2009, which claims the benefit of Japanese Patent Application No. 2008-058088 filed on Mar. 7, 2008, the disclosure of which is incorporated herein in its entirety by reference.

TECHNICAL FIELD

The present invention relates to an apparatus and a method for knitting fabric using elastic yarns at least as part of knitting yarns.

BACKGROUND ART

Hitherto, there has been known a structure of a knitting machine that has tension sensors confronting to the knitting yarn feeding pathway so that becomes controllable of knitting yarns to be fed to knitting needles at a desired tension (for example, see Patent Citation 1). By suppressing fluctuation of the knitting yarn tension when a fabric is being knitted, sizes of stitch loops are able to be kept uniform. In a knitting fabric, hand value is lost unless sizes of stitch loops achieve a suitable relation to the thickness of the knitting yarn used. In a flatbed knitting machine, when general knitting yarns are used, the thickness of the knitting yarn is chosen to nearly correspond to the gauge that indicates the number of knitting needles per 25.4 mm (1 inch). In accordance with the knitting yarn thickness, the knitting yarn tension is chosen, too, in such a manner that the stitch loop size that can provide the hand value as a suitable fabric is achieved.

Of the knitting fabrics knitted with the knitting machine, for portions requiring large retractility properties, for example, for the wearing openings of socks and gloves, etc., elastic yarns with particularly large extension coefficient as compared to general knitting yarns are used. Elastic yarns are also called rubber yarns, etc., and are made from polyurethane fibers, polyether/ester based fibers, and other fibers with large elasticity and retractility properties. In the elastic yarns, other fibers are used in combination, together with fiber materials with large retractility properties. For example, in the structures called covered yarns, core span yarns, etc., the outside of core fiber with large retractility properties, is covered with other fibers. 1

The elastic yarns are sometimes used not as ground yarns which construct knitting fabric itself but as inserted yarns which are inserted in a knitting fabric. The elastic yarns which are used as inserted yarns are used for knitting in the elongated state with comparatively large tension applied and in the fabric after knitting, tension is released and the elastic yarns shrink. To use elastic yarns, and to controll yarn tension and feed length, enables to knit a fabric in a finished state nearly close to the hand value corresponding to the gauge larger than the gauge of the knitting machine used (for example, see Patent Citation 2).

Patent Citation 1: U.S. Pat. No. 3,858,416 Specifications

Patent Citation 2: International Publication WO04/094712 pamphlet

DISCLOSURE OF THE INVENTION

Technical Problem

Formation of stitch loops by knitting needles is intermittently performed when a fabric is being knitted, and therefore, the knitting yarn tension varies in response to knitting action of knitting needles. However, it is difficult to control tension to eliminate this kind of fluctuation and the tension is controlled while the knitting action of knitting needles are in a resting phase. For example, in the flatbed knitting machine, knitting needles are driven by a cam mounted to a carriage while the carriage is running back and forth along the linear needle bed and a knitting course of a fabric is formed. When the carriage reverses the running direction, the knitting action of knitting needles rests, and therefore, the knitting yarn tension is controlled during this phase. The tension control might be performed by returning the knitting yarn to the feed side when the tension of the knitting yarn lacks and by further feeing the knitting yarn when the knitting yarn tension is excessive.

In the flatbed knitting machine, tension is adjusted before knitting each knitting course by dispatching and retracting actions of the knitting yarn by the knitting yarn sending device so that the tension achieves the designated value while measuring the tension in the yarn route pathway of the elastic yarn from the knitting yarn sending device to the knitting needles which receive the yarn fed. However, even if the tension is adjusted before knitting in this way and the elastic yarn is fed at a yarn sending length decided in accordance with the correspondence relationship between the yarn tension and elongation percentage, the tension after knitting the knitting course is changed from the designated value. This change may be caused by slip of the elastic yarn in the yarn sending device, resistance in the yarn route pathway, or difference between the sending length of the elastic yarn and the consumption in the fabric by actual knitting, and others. Continuing knitting under this change and under the condition in which the tension of the elastic yarn differs from the designated value results in a different knitting width and different hand value of the knit products to be knitted.

Because starting to knit after the tension in the yarn route pathway is set to the designated value before knitting each knitting course does not generate any tension change in the knitting course, it is expected that the knitting width and the hand value of the fabric to be knitted could be kept constant. In order to match the tension of the elastic yarn to the designated value, the elastic yarn must be fed back by the yarn sending device for each knitting course and the yarn sending length must be corrected in the following knitting course. In order to carry out this kind of yarn sending length correction by the yarn sending device, the amount of sending out the elastic yarn from the yarn sending device to the yarn route pathway or the amount of pulling back the elastic yarn by the yarn sending device from the yarn route pathway must be decided. While this kind of action to decide or to correct is being performed by the yarn sending device, the carriage must be stopped or the elastic yarn must not be used for the following knitting course. This is because the accurate value is difficult to be detected because the tension varies during knitting by the use of the elastic yarn. When the carriage is stopped, the knitting efficiency is lowered, and when the elastic yarn is not used for the following knitting course, restrictions are applied to a knitting pattern, etc.

It is an object of the present invention to provide an apparatus and a method for knitting fabric using elastic yarns, on which the elastic yarns can be used while correcting the difference between a set tension and an actual tension without being subject to a lowered knitting efficiency and to restrictions to knitting patterns.

Technical Solution

The present invention provides an apparatus for knitting fabric using elastic yarns with retractility properties which are fed to knitting needles at least as part of knitting yarns for knitting fabrics under a designated tension T1, comprising:

a yarn sending device that sends elastic yarns to knitting needles at a designated yarn sending length F;

a tension meter that confronts yarn route pathway established between the yarn sending device and the knitting needles, and detects tension T2 of elastic yarns in a resting phase;

means for calculating difference to commute a length L of elastic yarns, present in the yarn route pathway under the tension T1 designated to the yarns and under the tension T2 which the tension meter detects, into natural lengths L1, L2 when the tensions T1, T2 are not exerted respectively, and to calculate the difference of natural lengths L1–L2; and means for correcting yarn sending length F of the yarn sending device so that the difference between natural lengths L1, L2 calculated by the means for calculating difference decreases.

The present invention provides the apparatus for knitting fabric using elastic yarns, further comprising means for holding relationship that actually measures the correspondence relation between the tension T and the elongation percentage α of elastic yarns by the use of the yarn sending device and the tension meter, and holds measured results as data, wherein said means for calculating difference commutes the elastic yarn lengths in the yarn route pathway into said natural lengths L1, L2 on the basis of the correspondence relation between the tension T and the elongation percentage α held in the means for holding relationship.

The present invention provides the apparatus for knitting fabric using elastic yarns, wherein said means for correcting yarn sending length corrects the elastic yarn sending length with respect to a changed portion of the sending length associated with elastic deformation when the elastic yarns are fed by the yarn sending device.

The present invention provides the apparatus for knitting fabric using elastic yarns, wherein the apparatus for knitting fabric is a flatbed knitting machine in which a carriage runs back and forth along a needle bed extending linearly, and said resting phase is at least one of timings in which the carriage reverses the running direction.

Furthermore, the present invention provides a method for knitting fabric used under a designated tension T1 by feeding elastic yarns with retractility properties at least as part of the knitting yarns from a yarn sending device to knitting needles at a designated yarn sending length F, comprising steps of:

providing a tension meter for detecting tension T2 of elastic yarns during knitting resting phase, which is installed in a yarn route pathway located between a yarn sending device and knitting needles;

commuting a lengths L of elastic yarns present in the yarn route pathway under the designated tension T1 and under the tension T2 which the tension meter detects, into natural lengths L1, L2 when the tensions T1, T2 are not exerted, and calculating the difference of natural lengths L1–L2; and correcting yarn sending length F of the yarn sending device so that the difference between natural lengths L1, L2 decreases.

ADVANTAGEOUS EFFECTS

According to the present invention, the tension T2 of elastic yarns is only to be detected during resting phase of knitting by a tension meter, so that short resting phase of knitting with use of elastic yarns is acceptable, and the lowered knitting efficiency and restrictions to knitting patterns can be avoided. The means for calculating difference commutes the length L existing in the yarn route pathway into the natural length L2 when no tension T2 is exerted, and calculates difference between the natural length L2 and the natural length L1 under the designated tension T1. The means for correcting yarn sending length corrects the yarn sending length F of the yarn sending device in such a manner that the difference between natural lengths L1, L2 decreases, and therefore, elastic yarns are able to be used while the difference between the set tension and the actual tension is being corrected.

In addition, according to the present invention, the correspondence relationship between the tension T and the elongation percentage α of elastic yarns is actually measured by the use of a yarn sending device and a tension meter which the knitting machine is equipped with, and is kept as data, and therefore, the data necessary for knitting by the use of elastic yarns is able to be obtained and kept by the knitting machine itself. The means for calculating difference commutes the elastic yarn length in the yarn route pathway into the natural length L1, L2 on the basis of the correspondence relationship between the tension T and elongation percentage, and is therefore able to easily correct the yarn sending length for elastic yarns actually used.

Furthermore, according to the present invention, the elastic yarn sending length is corrected with respect to the changed portion of the sending length associated with elastic deformation when elastic yarns are fed by the yarn sending device, and therefore, the accuracy of yarn sending length correction can be increased.

Still furthermore, according to the present invention, the tension T2 in the yarn-handling course is detected for correcting the yarn feed rate during a period in which the carriage reverses the running direction between knitting courses of the flat knitting machine, and therefore, the yarn tension can be controlled without lowering the knitting efficiency.

Still additionally, according to the present invention, the tension T2 of elastic yarns is detected during resting phase, elastic yarns are therefore able to be used without lowering of the knitting efficiency and restrictions to knitting patterns, while correcting the difference between the set tension and the actual tension.

EXPLANATION OF REFERENCE

Figure 1:
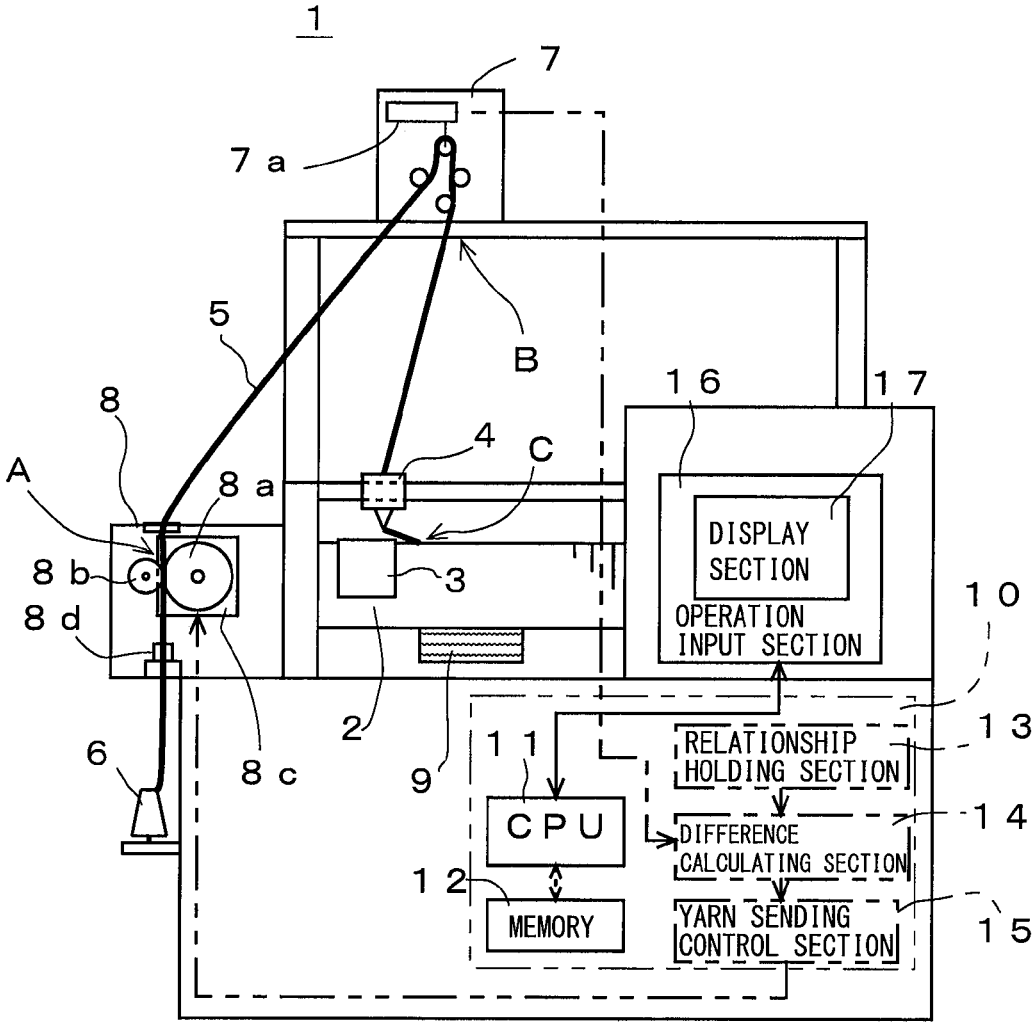
FIG. 1 is a block diagram that simplistically shows an overall structure of a knitting machine 1 as one embodiment of the present invention.

1, 21 Knitting machine
2 Needle bed
3 Carriage

4 Yarn feeder
5 Rubber yarn
7 Tension meter
8 Yarn sending device
10 Control equipment
13 Relationship holding section
14 Difference calculating section
15 Yarn sending control section

BEST MODE FOR CARRYING OUT THE INVENTION

FIG. 1 simplistically shows an overall structure of a knitting machine 1 as one embodiment of the present invention. For the convenience of explanation, in the knitting machine 1, only main component parts related for the use of elastic yarns are shown. Furthermore, even main component parts may be shown with the relative sizes and directions varied.

In the knitting machine 1, cams mounted to a carriage 3 is worked on knitting needles arranged in a needle bed 2 at predetermined pitches while the carriage 3 is running back and forth along the longitudinal direction of the needle bed 2. The carriage 3 runs accompanied by a yarn feeder 4 and knitting yarns are fed to the knitting needles from the yarn feeder 4. A rubber yarn 5 which is an elastic yarn is fed from the yarn feeder 4 to knitting needles as, for example, an insertion yarn to a fabric. The rubber yarn 5 is fed to a yarn route pathway passing a tension meter 7 from, for example, rubber yarn cone 6 supported by the side surface of the knitting machine 1 via a yarn sending device 8 and is used for knitting a fabric 9 in the needle bed 2. The yarn route pathway of the knitting machine 1 passes the tension meter 7 installed at the upper side so that the knitting yarn is fed by a downward yarn feeding.

The yarn sending length F of the yarn sending device 8 is corrected by a control equipment 10. The control equipment 10 includes CPU11, memory 12, and others, and functions as a relationship holding section 13, difference calculating section 14, yarn sending control section 15, etc. in accordance with a program stored in the memory 12. To the control equipment 10, an operation input section 16 equipped with a keyboard, switches, etc., a display section 17 that displays picture images, commands, status, etc. are connected, too.

To the tension meter 7, a tension sensor 7*a* is equipped and is able to detect at any time the tension T of the rubber yarn 5 which is fed from the yarn sending device 8 to the knitting needles on the needle bed 2 via the yarn feeder 4. In the knitting machine 1, when the carriage 3 runs back and forth, the carriage 3 reverses the running direction when it passes the knitting end of the fabric 9. When the carriage 3 reverses the running direction outside the knitting width of the fabric 9, feed of the rubber yarn 5 to the knitting needles is stopped. During this resting phase, tension T2 of the rubber yarn 5 is detected by the tension meter 7. The yarn sending length F, which is the amount of the rubber yarn 5 sent from the yarn sending device 8 to the yarn route pathway for each knitting course, is able to be obtained in advance as length of the rubber yarn 5 consumed under the designated tension T1 for each knitting course. When the set accuracy of the yarn sending length F is high, the tension T2 detected between relevant knitting courses is expected to be close to the designated tension T1.

The yarn sending device 8 sends out the rubber yarn 5 to the yarn route pathway from a location A contained between a drive pulley 8*a* and a press pulley 8*b* to a location C at which the yarn is fed to the knitting needles via a location B at which the yarn comes out from the tension meter 7. Of the yarn route pathway, the section from the location A to the location B is constant. The section between the location B and the location C varies as the carriage 3 runs, but is able to be calculated from position data of the carriage 3. The drive pulley 8*a* is driven by a motor 8*c*. The motor 8*c* is able to rotate normally and reversely. In normal rotation, the rubber yarn 5 is sent out to the yarn route pathway, and in reverse rotation, the rubber yarn 5 is pulled back from the yarn route pathway. When the motor 8*c* is reversed to pull back the rubber yarn 5, a yarn guiding member 8*d* is installed with care to prevent from being tangled in the yarn sending device 8 so as to be smoothly returned to the rubber yarn cone 6 side.

Figure 2:
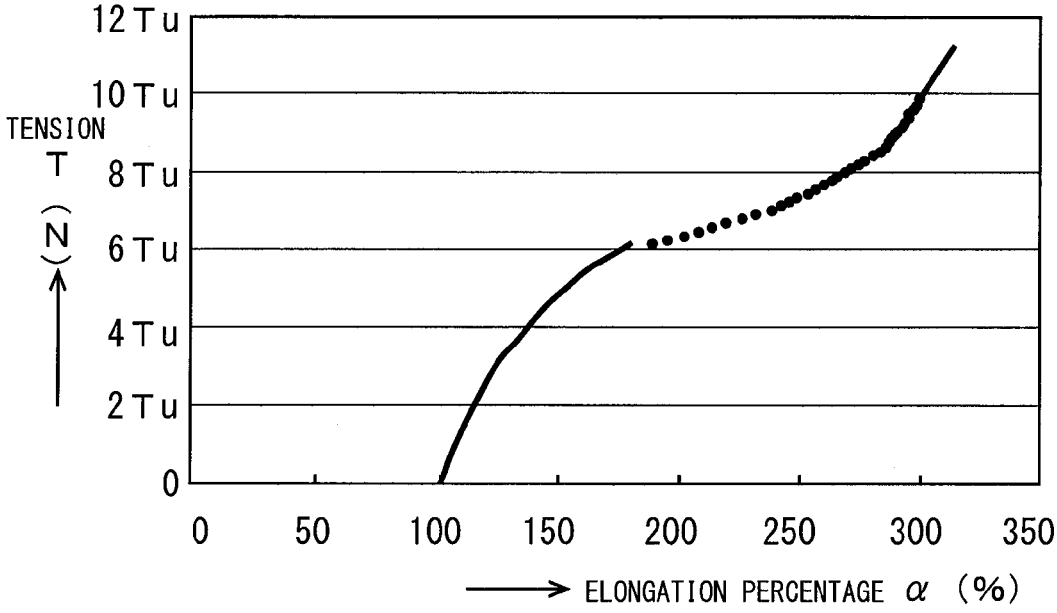
FIG. 2 is a graph that shows an example of measurement data on the relationship between tension T (N) and elongation percentage α (%) of the rubber yarn 5.
Figure 2:
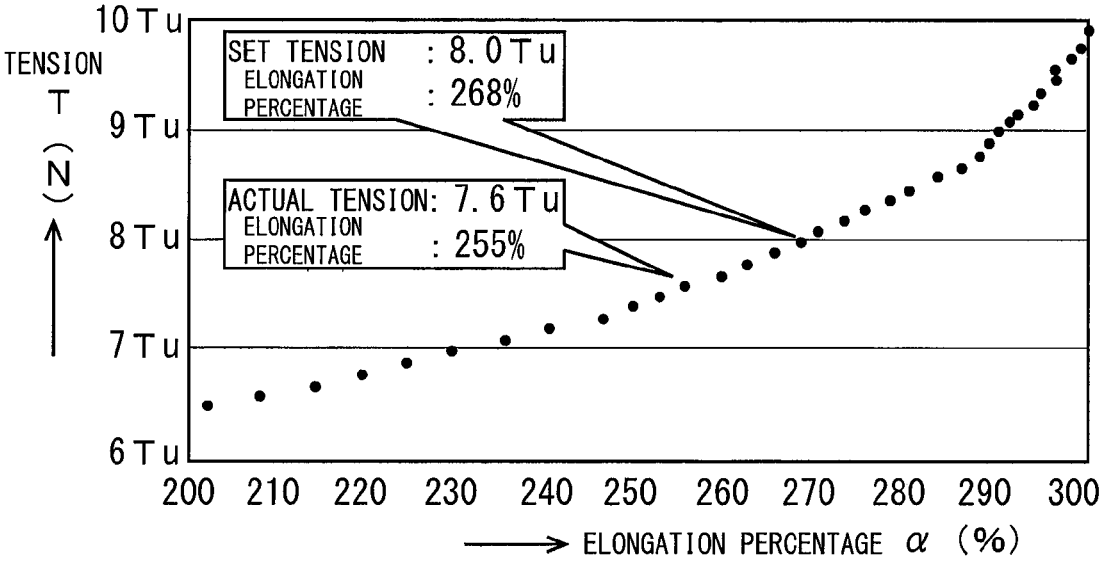

FIG. 2 show examples of measurement data with respect to the relationship between the tension T (N) and the elongation percentage α (%) of the rubber yarn 5. FIG. 2(*a*) shows the overall data held as the rubber yarn characteristics table in a relationship holding section 13 and FIG. 2(*b*) shows partial data. The tension Tu used as a unit is, for example, about 0.01N (0.001 kgf). The tension T is measured by feeding and holding the rubber yarn 5 to the knitting needles via the yarn route pathway and adjusted to bring tension T detected by the tension meter 7 to nearly zero. However, the tension meter 7 lowers the detection accuracy when the tension T becomes nearly zero. When the tension T becomes nearly zero, the elongation percentage α of the rubber tarn 5 is 100%, and the rubber yarn 5 is in the natural length state.

The correspondence relationship of the elongation percentage α to the tension T as in the case of FIG. 2(*a*) is able to be measured by bringing the tension T to the vicinity of zero, then, reversing the motor 8*c* of the yarn sending device 8, and pulling back the rubber yarn 5 from the yarn route pathway. The rubber yarn 5 returned from the reversed drive pulley 8*a* to the rubber yarn cone 6 side has the tension T brought to the zero state, and therefore, the elongation percentage α is able to be obtained from the relationship between the pull-back length by the drive pulley 8*a* and the length L of the yarn route pathway. For example, pulling back the rubber yarn 5 by ½L, the length one half of the yarn route pathway length L, achieves the state in which the rubber yarn 5 of natural length ½L is stretched to the length L of the yarn route pathway, and the elongation percentage α becomes 200%. Pulling it back by ⅔ L in natural length results in 300% elongation percentage α.

FIG. 2(*b*) shows a range of the elongation percentage α of the rubber yarn 5 from 200% to 300%, which is enlarged assuming a case of using the rubber yarn 5 to be knitted in this range. For example, when the tension T1 is designated to be set to 8.0 Tu, the corresponding elongation percent a is 268%. Meanwhile, when the actual tension T2 actually detected after the completion of certain knitting course is, for example, 7.6 Tu, the elongation percentage α becomes 255%. The actual tension T2 is lowered from the set tension T1, and this indicates that the rubber yarn 5 is sent in excess. Consequently, by correcting the sending length of the rubber yarn 5 to be reduced in the following knitting course, it is expected that the actual tension T2 next measured would increase.

Figure 3:
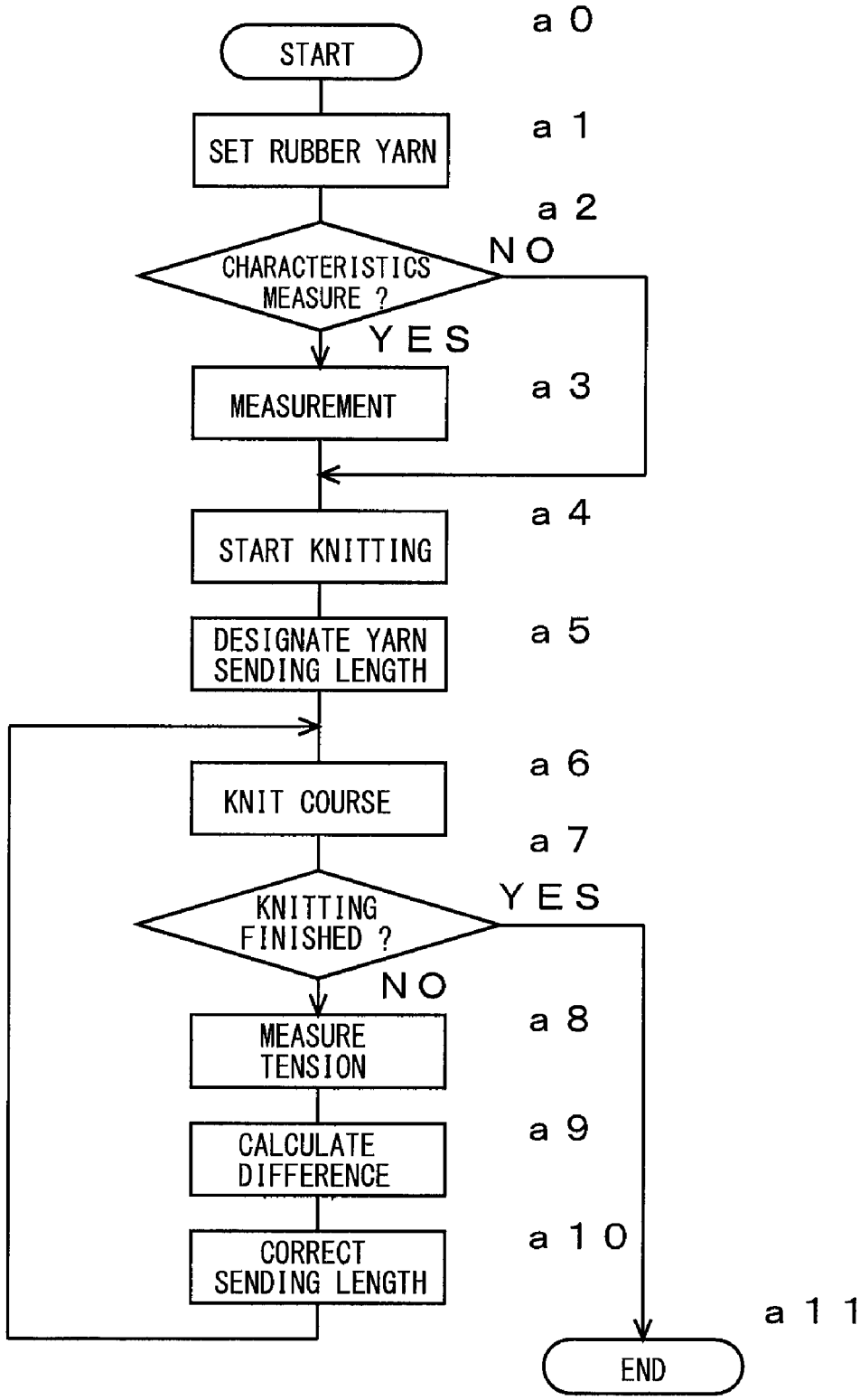
FIG. 3 is a flow chart that schematically indicates a procedures used for knitting rubber yarn 5 while a control equipment 10 is correcting the yarn sending length.

FIG. 3 shows schematically the procedures to use the rubber yarn 5 for knitting while the control equipment 10 of FIG. 1 is correcting the yarn sending length. In Step a0, the knitting machine 1 begins to be used, and in Step a1, the rubber yarn 5 is set to the knitting machine 1. First of all, a rubber yarn cone 6 is mounted to a holder, and the rubber yarn 5 is pulled out and fed from the yarn sending device 8 to the knitting needles via the tension meter 7 and the yarn feeder 4. In Step a2, judgment as to whether the characteristics as shown in FIG. 2 should be measured is made by an operator using an operation input section 16. When the characteristics are measured, in Step a3, the tension meter 7 and the yarn sending section 8 are utilized to obtain the foregoing data on correspondence relationship between the tension T and the elongation percentage α in accordance with the program created in advance.

When either measurement in step a3 is finished or characteristics measurement is judged to be not required in step a2, knitting of fabric using the rubber yarn 5 is started in step a4. In Step a5, the yarn sending length F necessary for the following knitting course is designated. The yarn sending control section 15 of FIG. 1 controls the motor 8*c*, so as to feed the rubber yarn 5 at the designated sending length F from the yarn sending device 8 to the yarn route pathway over a period of the following knitting course.

In Step a6, a fabric of the following knitting course is knitted while using the rubber yarn 5 at the designated yarn sending length. In Step a7, it is determined whether the knitting to use the rubber yarn 5 is to be finished. When the knitting is determined not to be finished, the process moves to Step a8 and the tension T of the rubber yarn 5 is measured by the tension meter 7. This measurement is performed while the supply and the consumption of the rubber yarn 5 are stopped because the carriage 3 reverses the running direction. Consequently, the tension T is able to be measured in a state free of any variation and without lowering the knitting efficiency, and is designated as the actual tension T2. In addition, even in the following knitting course, the rubber yarn 5 is able to be used too, and no restriction results in a knitting pattern.

In Step a9, the difference calculating section 14 of FIG. 1 calculates natural lengths L1, L2 of the rubber yarn 5 existing in the yarn route pathway of length L under the set tension T1 and under the actual tension T2, respectively, in accordance with following Eq. (1) and Eq. (2) and further calculates the difference ΔL in accordance with Eq. (3).

$$L1 = L/268 \times 100 \quad \text{Eq. (1)}$$

$$L2 = L/255 \times 100 \quad \text{Eq. (2)}$$

$$\Delta L = L1 - L2 \quad \text{Eq. (3)}$$

In Step a10, the yarn sending control section 15 calculates the adjustment ratio β (%) for correcting the yarn sending length from the yarn sending device 8 to the yarn route pathway in the following knitting course in accordance with the following Eq. (4).

$$\beta = (\text{sending length of the preceding course} + \Delta L)/\text{sending length of the preceding course} \times 100\% \quad \text{Eq. (4)}$$

If ΔL is positive, the adjustment ratio β calculated by Eq. (4) becomes larger than 100%, and the sending length of the following knitting course increases. The actual tension T2 after the completion of the following knitting course lowers and the corresponding natural length L2 increases, and it is expected that the difference between the natural length L1 and the natural length L2 decreases. In addition, when ΔL is negative, the adjustment ratio β becomes smaller than 100% and the sending length of the following knitting course decreases. The actual tension T2 after the completion of the following knitting course increases and the corresponding natural length L2 decreases, and it is expected that the difference between the natural length L1 and the natural length L2 becomes decreases, too. At any rate, the yarn sending length is corrected in the direction in which the difference between natural lengths L1, L2 decreases.

Because the yarn sending length per 1 step is fixed if the motor 8*c* is a stepping motor, the yarn sending length is able to be obtained as the number of steps to drive the motor 8*c*. The yarn sending length, to be necessary for the following knitting course, is able to be obtained by multiplying the yarn sending length at the set tension T1 by the final adjustment ratio which is the product of the adjustment ratio β calculated by Eq. (4) multiplied by the adjustment ratio in the last knitting course.

Incidentally, when the adjustment ratio β is calculated, it is desirable to correct the rubber yarn sending length for the difference ΔL. In the structure like the yarn sending device 8, the rubber yarn 5 is pinched between the drive pulley 8*a* and press pulley 8*b* and to sent out. Between the drive pulley 8*a* and the press pulley 8*b*, the rubber yarn 5 gets crushed and an error is generated in the length of the rubber yarn 5 sent out. For example, even if the rubber yarn 5 is sent out the yarn sending length of 100 mm from the yarn sending device 8, the natural length of actual rubber yarn 5 may be 80 mm. In such event, the difference should be corrected by ΔL/0.8.

When correction of the yarn sending length in Step a10 is finished, the corrected yarn sending length is designated and the course knitting from Step a6 is repeated. In Step a7, if the knitting, in which the rubber yarn 5 is used, is determined to be finished, the procedure for using the rubber yarn 5 for knitting is finished in Step a11.

Figures 4, 5:
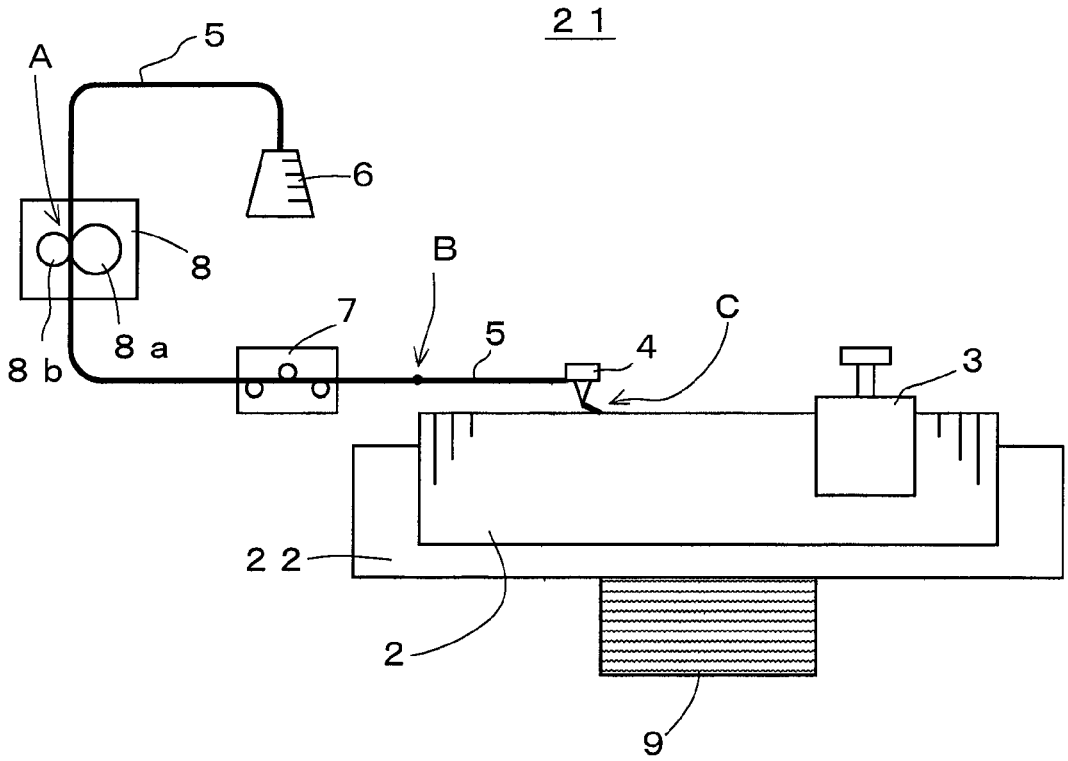
FIG. 4 is a graphic chart that shows examples of yarn sending length correction, conducted in the knitting machine 1 of FIG. 1 according to the procedure of FIG. 3, when a knitting fabric 9 is being knitted while using rubber yarn 5.
FIG. 5 is a block diagram that shows an example of a knitting machine 21 preferable for calculating the sending length correction value for each knitting course as another embodiment of the present invention.

FIG. 4 shows an example of yarn sending length correction performed when the fabric 9 is knitted by using the rubber yarn 5 in accordance with the procedure of FIG. 3 by the knitting machine 1 of FIG. 1. In this example, the yarn sending length is corrected not in each knitting course but every time the carriage 3 runs back and forth. In the first knitting course 1, for example, knitting is started after the tension t0 such as 8.0Tu of FIG. 2 is designated as the set tension T1, and the actual tension T2 right before the course is adjusted to t0. The sending length, which is the sending length from the yarn sending device 8, requires the theoretical value F0 at tension t0. Because this is the first knitting course, the calculation value of the adjustment ratio β, previous value, and final value shall be all set to 100%, and the correction value of the sending length shall be set to F0, too. In the following knitting course 2, the knitting direction is reversed to the direction of the knitting course 1, but the sending length correction value is set to F0 and is not changed. The actual tension T2 right before the course may differ from the set tension t0, but measurement does not take place.

In knitting courses 3, 4, the actual tension T2 right before the course is measured as t1, and the difference ΔL of the natural length is calculated based on the difference from t0 as the set tension T1, and the sending length F0 is corrected. When the calculated value of the adjustment ratio β calculated by Eq. (4) becomes 73% based on the difference ΔL, the adjustment ratios of 100% in the previous knitting courses 1 and 2 are multiplied and the final value of the adjustment ratio becomes 73%. Consequently, the sending length correction value becomes 0.73×F0.

In the knitting course 5, 6, the actual tension T2 right before the course is measured as t2, and, the difference ΔL of the natural length is calculated based on the difference from t0 as the set tension T1, and the sending length F0 is corrected. When the calculated value of the adjustment rate β calculated by Eq. (4) becomes 104% based on the difference ΔL, the adjustment ratio of 73% in the previous knitting courses 3, 4 is multiplied and the final value of the adjustment ratio becomes 75%. Consequently, the sending length correction value becomes 0.75×F0.

In the knitting courses 7, 8, the actual tension T2 right before the course is measured as t3, and, the difference ΔL of the natural length is calculated based on the difference from t0 as the set tension T1, and the sending length F0 is corrected. When the calculated value of the adjustment rate β calculated by Eq. (4) becomes 114% based on the difference ΔL, the adjustment ratio of 75% in the previous knitting courses 5, 6 is multiplied and the final value of the adjustment ratio becomes 85%. Consequently, the sending length correction value becomes 0.85×F0.

For the subsequent knitting courses, sending length correction value can be obtained in the same manner. Incidentally, needless to say, the sending length correction value may be calculated for each knitting course. Because the knitting yarn is fed by the downward yarn feeding in the knitting machine 1, the rubber yarn 5 is able to be fed under the nearly same conditions in whichever running direction of the carriage 3, highly accurate yarn sending length correction can be achieved even when control is performed for each of reciprocating knitting course.

FIG. 5 shows an example of a knitting machine 21 as another embodiment of the present invention, in which the sending length correction value is preferable to be calculated for each knitting course. In the knitting machine 21, like reference characters are assigned to the portions corresponding to those of the knitting machine 1 of FIG. 1 and redundant explanations will be omitted. In the knitting machine 21, side yarn feeding is carried out, in which the rubber yarn 5 being fed is supported at the side of the frame 22, and the rubber yarn 5 is fed by a sideward yarn feeding from one side of the longitudinal direction of the needle bed 2. Consequently, in accordance with the direction in which the carriage 3 takes away the yarn feeder 4, the length of the rubber yarn 5, fed to the yarn route pathway, varies. When the yarn feeder 4 comes close to the feed side, the yarn feeder 4 moves and feeds the rubber yarn 5 already fed to the yarn route pathway to the knitting needles. Consequently, the amount of rubber yarn 5 sent out from the yarn sending device 8 during the knitting course decreases. When the carriage 3 runs away from the feed side, a large amount of rubber yarn 5 must be sent out from the yarn sending device 8.

In this kind of knitting machine 21, it is preferable that the sending length is corrected for each knitting course, and in addition, the yarn route pathway is set in a range to the knit end of the fabric 9 on each knitting course finishing side. In FIG. 5, for convenience of explanation, the carriage 3 is brought to rightward outside of the fabric 9 but the figure shows the condition in which the yarn feeder 4 runs leftwards to come close to the feed side of the rubber yarn 5. In this case, the knitting end on the left side of the fabric 9 becomes the location C at the end of the yarn route pathway. In the knitting course in which the yarn feeder 4 is took away by the carriage 3 runs rightwards, the location C becomes the knitting end on the right side of fabric 9.

In the foregoing description, flatbed knitting machines are used, as knitting machines 1, 21, but the present invention is able to be applied to knitting machines of other types. For example, in a circular knitting machine for continuously knitting fabrics, a short resting phase is to be provided for measuring the actual tension T2. The length of this resting phase may be any length necessary for stably measuring actual tension T2 and is able to be made shorter than the period necessary for adjusting the set tension T1 to suppress lowering of the production efficiency and to be free of restrictions to a knitting pattern. In addition, the correspondence relationship between the elongation percentage α and tension T of the rubber yarn 5 is actually measured and stored in the relationship holding section 13 as a rubber yarn characteristic table. Alternatively, the data measured by a test device other than the knitting machines 1, 21 may be loaded. Furthermore, this correspondence relationship may be utilized after mathematization.

The invention claimed is:

1. An apparatus for knitting fabric using elastic yarns with retractility properties which are fed to knitting needles at least as part of knitting yarns for knitting fabrics under a designated tension T1, comprising:

a yarn sending device that sends elastic yarns to knitting needles at a designated yarn sending length F;

a tension meter that confronts yarn route pathway established between the yarn sending device and the knitting needles, and detects tension T2 of elastic yarns in a resting phase;

means for calculating difference to commute a length L of elastic yarns, present in the yarn route pathway under the tension T1 designated to the yarns and under the tension T2 which the tension meter detects, into natural lengths L1, L2 when the tensions T1, T2 are not exerted respectively, and to calculate the difference of natural lengths L1−L2; and means for correcting yarn sending length F of the yarn sending device so that the difference between natural lengths L1, L2 calculated by the means for calculating difference decreases.

2. The apparatus for knitting fabric using elastic yarns according to claim 1, further comprising means for holding relationship that actually measures the correspondence relation between the tension T and the elongation percentage α of elastic yarns by the use of the yarn sending device and the tension meter, and holds measured results as data, wherein said means for calculating difference commutes the elastic yarn lengths in the yarn route pathway into said natural lengths L1, L2 on the basis of the correspondence relation between the tension T and the elongation percentage α held in the means for holding relationship.

3. The apparatus for knitting fabric using elastic yarns according to claim 1, wherein said means for correcting yarn sending length corrects the elastic yarn sending length with respect to a changed portion of the sending length associated with elastic deformation when the elastic yarns are fed by the yarn sending device.

4. The apparatus for knitting fabric using elastic yarns according to claim 1, wherein the apparatus for knitting fabric is a flatbed knitting machine in which a carriage runs back and forth along a needle bed extending linearly, and said resting phase is at least one of timings in which the carriage reverses the running direction.

5. A method for knitting fabric used under a designated tension T1 by feeding elastic yarns with retractility properties at least as part of the knitting yarns from a yarn sending device to knitting needles at a designated yarn sending length F, comprising steps of:

providing a tension meter for detecting tension T2 of elastic yarns during knitting resting phase, which is installed in a yarn route pathway located between a yarn sending device and knitting needles;

commuting a lengths L of elastic yarns present in the yarn route pathway under the designated tension T1 and under the tension T2 which the tension meter detects, into natural lengths L1, L2 when the tensions T1, T2 are not exerted, and calculating the difference of natural lengths L1–L2; and correcting yarn sending length F of the yarn sending device so that the difference between natural lengths L1, L2 decreases.

* * * * *